US007305969B2

(12) United States Patent
Ricco et al.

(10) Patent No.: US 7,305,969 B2
(45) Date of Patent: Dec. 11, 2007

(54) CONNECTION SYSTEM FOR A TUBULAR RAIL FOR HIGH-PRESSURE FLUID AND A SYSTEM FOR REDUCING THE SIZE OF THE RAIL

(75) Inventors: Mario Ricco, Casamassima (IT); Sisto Luigi De Matthaeis, Valenzano (IT); Raffaele Ricco, Valenzano (IT); Alfonso Di Meo, Valenzano (IT)

(73) Assignee: C.R.F. Societa Consortile Per Azioni, Orbassano (IT)

( * ) Notice: Subject to any disclaimer, the term of this patent is extended or adjusted under 35 U.S.C. 154(b) by 99 days.

(21) Appl. No.: 11/365,759

(22) Filed: Mar. 1, 2006

(65) Prior Publication Data

US 2007/0006850 A1 Jan. 11, 2007

(30) Foreign Application Priority Data

Jul. 8, 2005 (EP) ..... 05425485

(51) Int. Cl.
*F02M 37/04* (2006.01)

(52) U.S. Cl. ..... 123/456; 123/468

(58) Field of Classification Search ..... 123/456, 123/468, 469

See application file for complete search history.

(56) References Cited

U.S. PATENT DOCUMENTS 4,922,958 A * 5/1990 Lemp ..... 137/561 A
5,027,777 A * 7/1991 De Bruyn et al. ..... 123/468
5,161,834 A * 11/1992 Norkey ..... 285/319
5,390,638 A * 2/1995 Hornby et al. ..... 123/456
5,511,527 A * 4/1996 Lorraine et al. ..... 123/456
6,009,854 A * 1/2000 Rosgren et al. ..... 123/456
6,488,011 B1 * 12/2002 Frank et al. ..... 123/456
6,761,149 B2 * 7/2004 Frank ..... 123/456
6,978,765 B2 * 12/2005 Kilgore ..... 123/456
7,185,635 B2 * 3/2007 Frank et al. ..... 123/456
2001/0179056 12/2002 Frank et al. ..... 123/459
2003/0084880 A1 * 5/2003 Boecking et al. ..... 123/456
2004/0050364 A1 * 3/2004 Yanagii ..... 123/456
2007/0006848 A1 * 1/2007 Ricco et al. ..... 123/456

FOREIGN PATENT DOCUMENTS

DE 197 44 762 A1 10/1998

(Continued)

*Primary Examiner*—Thomas Moulis
(74) *Attorney, Agent, or Firm*—Seed IP Law Group PLLC

(57) ABSTRACT

In order to reduce the size of a tubular rail for a high-pressure fluid, the rail is obtained from a hollow body with an external diameter and an internal diameter, and has two terminal portions, each provided with an external milling to favour gripping thereof. The millings have an external diameter such as to ensure, together with a cylindrical portion of a coaxial element, a radial strength at least equal to that of the hollow body. Made between the hollow body and each cylindrical portion is a front connection. For this purpose, the cylindrical portion has a plane front surface, whilst each terminal portion has an internal milling with an internal diameter greater than the internal diameter of the hollow body so as to house the cylindrical portion and so as to form an annular shoulder. A washer of softer material is set between the annular shoulder and the front surface.

19 Claims, 3 Drawing Sheets

FOREIGN PATENT DOCUMENTS

| | | |
|---|---|---|
| DE | 101 43 511 A1 | 3/2003 |
| DE | 101 62 203 A1 | 7/2003 |
| EP | 1 245 826 A2 | 10/2002 |
| FR | 2 762 050 | 10/1998 |
| JP | 2001-227430 | 8/2001 |

* cited by examiner

CONNECTION SYSTEM FOR A TUBULAR RAIL FOR HIGH-PRESSURE FLUID AND A SYSTEM FOR REDUCING THE SIZE OF THE RAIL

BACKGROUND OF THE INVENTION

1. Field of the Invention

The present invention relates to a system for front connection between a tubular rail for high-pressure fluid, and to a system for reducing the size of the rail. In particular, the invention relates to a system that enables a reduction in the radial stresses to which the ends of the rail are subjected, for example in a system for supplying fuel for an internal-combustion engine.

2. Description of the Related Art

As is known, in internal-combustion engines with fuel injection, referred to as "common-rail engines", the fuel is brought up to a high pressure, in the region of at least 1600 bar, by means of a high-pressure pump, which sends the fuel to a common rail, having in general a tubular shape, which is in communication with each individual injector. In addition, the rail must be connected to other elements, such as a delivery duct of the high-pressure pump, a pressure sensor, a pressure-limiting valve, etc.

In modern injection engines, the aim is to reduce more and more the size of the rail, whilst for reasons of costs the target is to simplify its fabrication. Tubular fluid rails are known, made from normal-production pipes that enable the rails to be obtained at a lower cost than the ones obtained by forging. Said rails moreover each have at least one terminal portion that must be connected to a coaxial element of the aforesaid type.

Fluid rails of the known art in general present the drawback of requiring brackets that perform the dual function of enabling gripping of the piece being produced and of enabling its fixing to the engine. In the case where the tubular body is made from a normal-production pipe, the brackets must then be welded, or in any case constrained by means of some other type of connection, to the tubular body with an evident increase in costs and complication in the fabrication process. In the case where the tubular body is obtained by forging, the brackets in any case entail an increase in the weight of the entire system.

BRIEF SUMMARY OF THE INVENTION

One goal of the invention is to eliminate the brackets present in fluid rails of the known art, by means of appropriate solutions that afford high reliability and of limited cost.

According to the invention, the above goal is achieved by a system for reducing the dimensions of a rail for high-pressure fluid, set forth herein.

In particular, the above aim is achieved by providing a milling on the tubular body, which will not entail any oversizing thereof.

Another goal of the invention is to provide a system for connection of a tubular fluid rail to a coaxial element, without reducing its resistance to radial stresses.

According to the invention, the above further goal is achieved by a system for front connection between a tubular rail for fluid under pressure and at least one element coaxial thereto, as set forth herein.

In particular, the connection system is characterized in that both the usual pressure transducer and the usual connection for supply from the high-pressure pump are connected coaxially to the tubular rail, in a position corresponding to the ends thereof.

BRIEF DESCRIPTION OF THE SEVERAL VIEWS OF THE DRAWINGS

For a better understanding of the invention, a preferred embodiment is described hereinafter, purely by way of example, with the aid of the attached drawings, wherein.

DETAILED DESCRIPTION OF THE INVENTION

Figure 1:
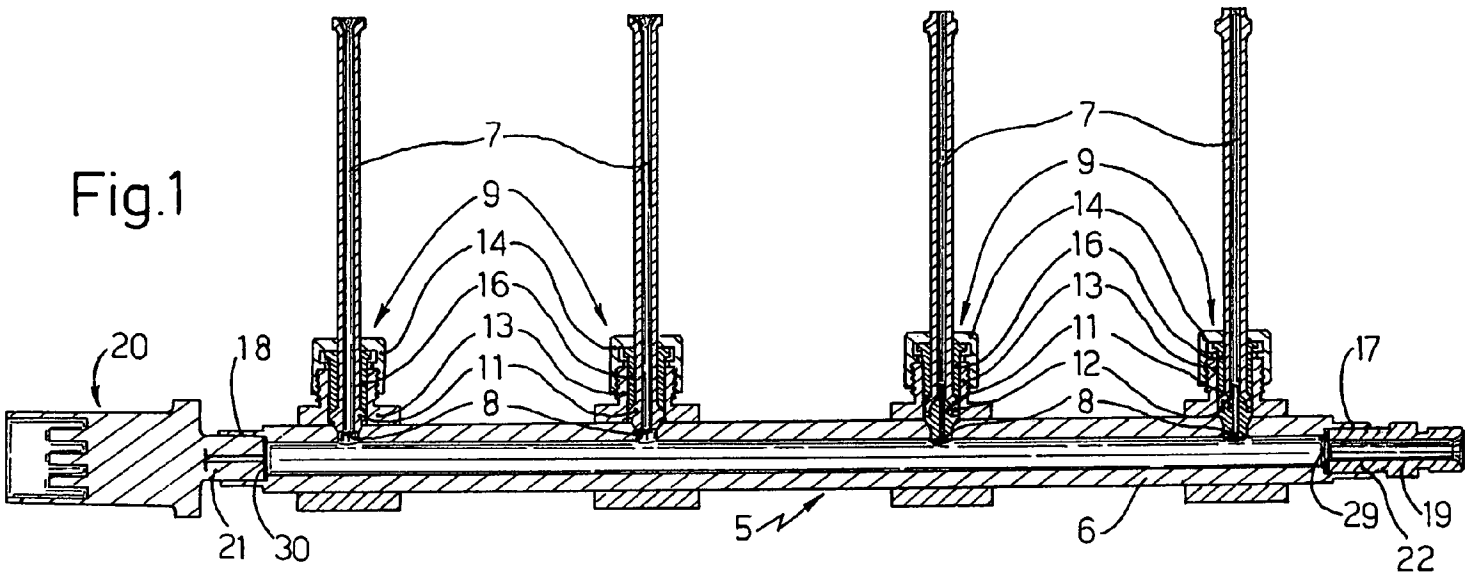
FIG. 1 is a median section of a tubular rail of a fuel-supply system, having a front-connection system, and a system for reducing the size according to the invention.
Figure 2:
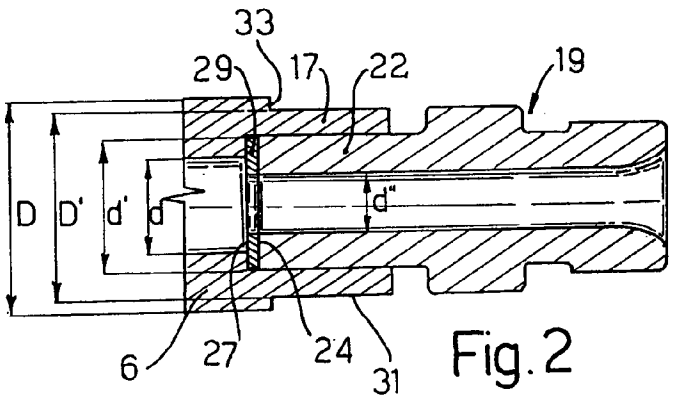
FIG. 2 is a detail of the connection system of FIG. 1, at an enlarged scale.
Figure 3:
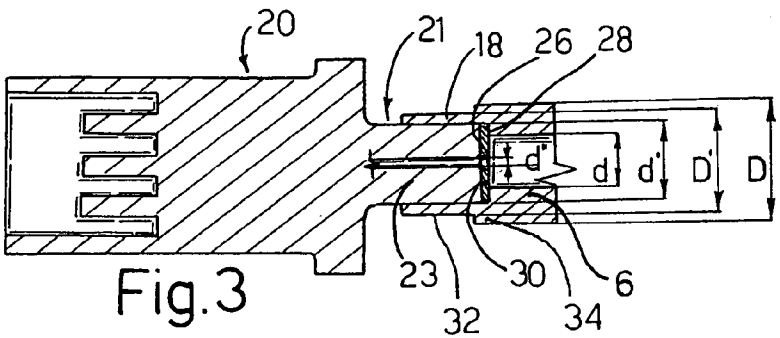
FIG. 3 is another detail of the connection system of FIG. 1, at another enlarged scale.

With reference to FIG. 1, number 5 designates as a whole a common rail for fuel under pressure for an internal-combustion engine (not shown), for example a four-cylinder engine. The rail 5 has a hollow body 6, which has a tubular shape and an external diameter D (FIGS. 2 and 3), for example obtained by drawing instead of by forging. The hollow body 6 is connected to the usual fuel injectors of the engine cylinders, by means of corresponding metal tubes 7. In particular, the hollow body 6 is equipped with four radial holes 8, in a position corresponding to each of which is connected a tube 7 by means of a connection device, designated as a whole by 9.

For this purpose, the tube 7 has a swollen end 11, whilst the device 9 comprises a sleeve 13 threaded on the outside, which is fixed on the hollow body 6 in any known way. Screwed on the sleeve 13 is a ring nut 14, which, via a bushing 16, is designed to block the end 11 of the tube 7 against the hollow body 6. In particular, in the two tubes 7 on the left in FIG. 1, the end 11 engages directly the edge of the hole 8, whilst in the two tubes 7 on the right, the end 11 engages a seal element 12, tapered in the two directions, which in turn engages the edge of the hole 8.

The hollow body 6 has a pre-set internal diameter d (FIGS. 2 and 3) and a pre-set external diameter D. For reasons of encumbrance, the axial length of the hollow body 6 is fixed, so that the internal diameter d determines the accumulation volume available for supply of the injectors. The accumulation volume markedly affects functionality of the fuel-injection system, in particular the behaviour of the injection pressure, and consequently its value must be chosen appropriately.

Once the value of the internal diameter d has been defined so as to optimize the behaviour of the supply pressure during operation, the minimum admissible value of the external diameter $D_{min}$ is determined. In fact, this minimum value must be such as to bestow upon the hollow body 6 the sturdiness necessary for withstanding the stresses induced by the pressure within the hollow body 6 during normal operation of the engine. Hence, the external diameter D of the hollow body 6 must be assumed greater than or equal to $D_{min}$ taking into account that, the greater said diameter D, the greater the overall dimensions, weight and costs.

According to a purpose of the invention, to enable gripping of the hollow body 6 during production, or to carry out normal maintenance operations during engine life, in a position corresponding to each terminal portion 17 and 18 of the hollow body 6 two millings 31 and 32 are performed, which define two shoulders 33 and 34 on the outer surface of the hollow body 6. Designated by 27 and 28 are instead two shoulders internal to the hollow body 6, defined in a position corresponding to a variation of the internal diameter, which is brought from the value d to a value d' greater than d, by means of two internal millings of the terminal portions 17 and 18.

Hereinafter, D' designates the diameter of the largest circumference circumscribed in the cross section of the tubular body 6 in a position corresponding to the millings 31, 32, which can have a circular or else a prismatic cross section. In particular, each external milling 31, 32 can have a hexagonal cross section to enable blocking of the rail 5 using appropriate tools.

The internal milling of the terminal portions 17, 18 must be obtained in such a way that the shoulders 27 and 28 are set in a position corresponding to the portion of the hollow body 6 with external diameter D; i.e., they must belong to a cross section of the tubular body 6 with external diameter D. Consequently, each external milling 31, 32 must have a length smaller than the corresponding internal milling.

The external millings 31 and 32 locally reduce the radial strength of the hollow body 6. Since enclosed within the hollow body 6 is fuel at a high pressure, there would derive the need to oversize the diameter D, in such a way that the diameter D' is still greater than or equal to the diameter $D_{min}$ defined previously.

The terminal portions 17 and 18 of the hollow body 6 are designed to be connected at the front to corresponding coaxial elements 19 and 21. In particular, the element 19 represents a union for connection of the hollow body 6 with a delivery pipe (not shown) of the high-pressure fuel pump. The element 21 represents a union for connection of a pressure transducer 20, for determining the pressure of the fuel in the rail 5.

Each of the two elements 19 and 21 has a corresponding cylindrical hollow portion 22 and 23, having an external diameter substantially equal to the internal diameter d' of the corresponding terminal portion 17, 18 of the hollow body 6. Consequently, hereinafter d' designates also the external diameter of each cylindrical portion 22, 23. This cylindrical portion 22, 23 moreover has an internal diameter d" smaller than the internal diameter d of the hollow body 6.

The two coaxial elements 19 and 21 each have an external thread in a position corresponding to the respective cylindrical portion 22 and 23, which has a nominal diameter equal to the aforesaid external diameter d'. The external thread engages a similar internal thread of the hollow body 6. It is understood that the internal diameters d' of the internal millings of the terminal portions 17 and 18 of the hollow body 6 can differ from one another.

Each cylindrical portion 22 and 23 terminates with a front surface 24 and 26, which is annular and plane. Set between each front surface 24 and 26 and the corresponding shoulder 27 and 28 is a corresponding washer 29 and 30, which is made of a relatively soft material as compared to that of the hollow body 6 and of the two coaxial elements 19 and 21. In particular, the hollow body 6 of the rail 5 and the cylindrical portions 22 and 23 of the coaxial elements 19 and 21 are made of steel, whilst the washers 29 and 30 are made of soft iron.

The washers 29 and 30, providing the seal between the unions 19 and 21 and the hollow body 6, are such that the stresses to which the terminal portions 17 and 18 of the hollow body 6 are subjected are only due to the threaded connection and not to the pressure of the fuel. In this way, the radial stresses are much more contained, and consequently the diameter D' proves sufficient to guarantee resistance of the hollow body 6 to these stresses. Without this solution, i.e., if the milling were obtained in an area corresponding to a high-pressure portion of the hollow body 6, it would be necessary to use a hollow body 6 with a larger external diameter D.

As an alternative to a threaded connection between the coaxial elements 19 and 21 and the hollow body 6, the cylindrical portions 22 and 23 of the coaxial elements 19 and 21 can have an external diameter D' slightly greater than the internal diameter of the corresponding terminal portion 17 and 18 of the hollow body 6. In this way, each cylindrical portion 22 and 23 can be fixed on the terminal portion 17 and 18 of the hollow body 6 by axial force forcing, or else by exploiting thermal expansion, by means of pre-heating of each terminal portion 17, 18.

As regards the radial strength of the coaxial elements 19 and 21, the respective internal diameter d" of the cylindrical portions 22 and 23 must be sufficiently smaller than the external diameter d' so as to obtain a pre-set thickness d'-d". In this way, the structural strength of the cylindrical portions 22 and 23 is guaranteed. As already mentioned, the coaxial element 19 is formed by a diameter adapter for the usual pipe for connection to the high-pressure fuel pump. In turn, the coaxial element 21 is made of a single piece with the pressure transducer 20, which can be replaced by a valve for controlling the pressure of the fuel in the rail 5. In either case, the internal diameter d" of the cylindrical portion 22, 23 of the coaxial element 19, 21 is very small.

Figure 4:
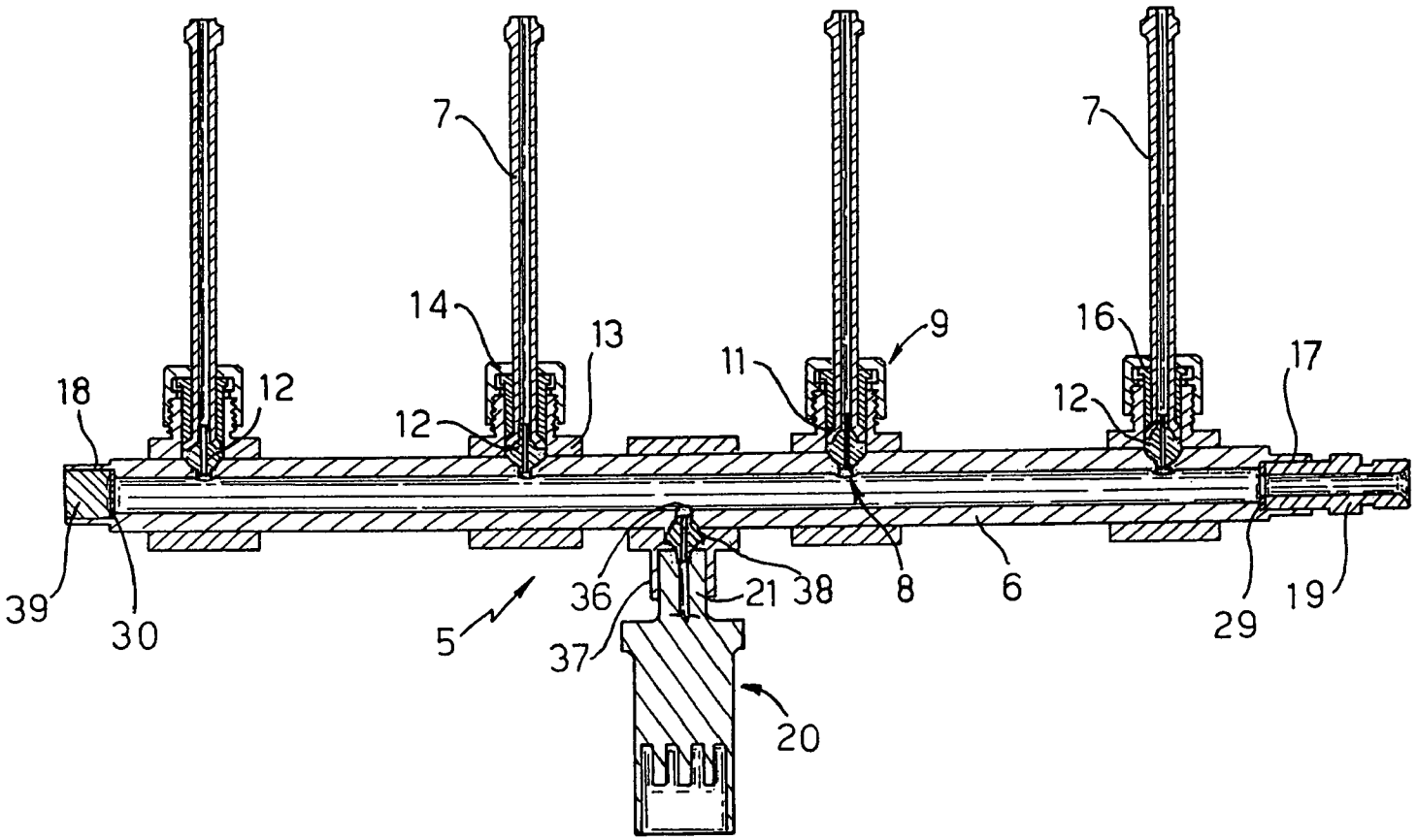
FIG. 4 is a median section of a variant of the system of FIG. 1.
Figure 5:
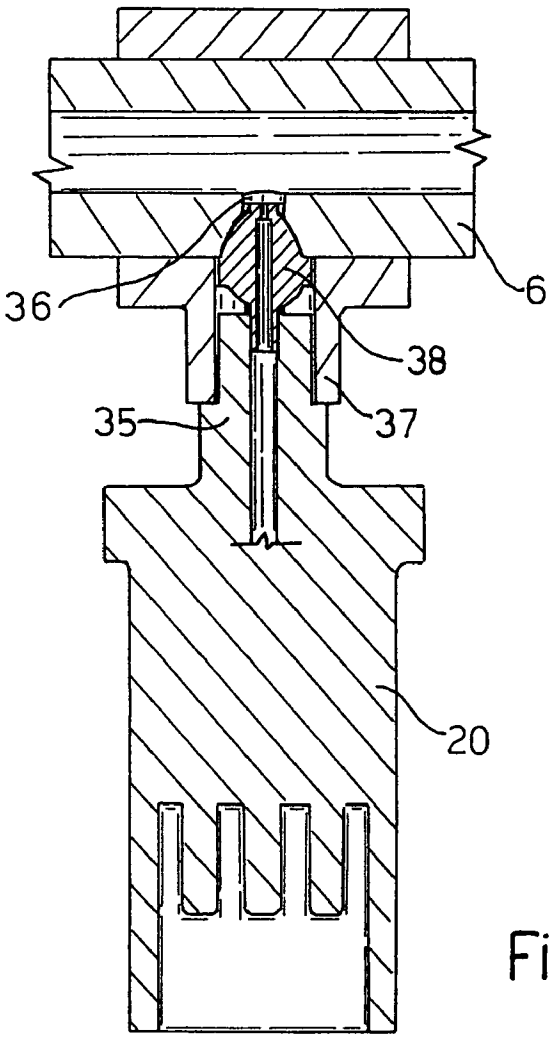
FIG. 5 is a detail of FIG. 4, at an enlarged scale.
Figure 6:
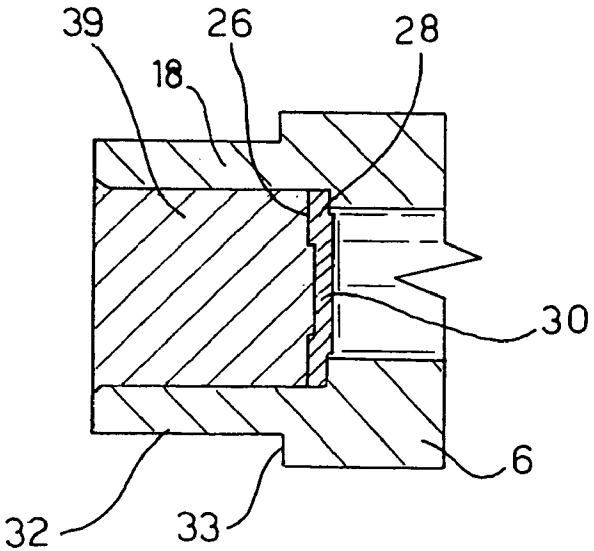
FIG. 6 is another detail of FIG. 4, also at an enlarged scale.

In the variant of FIG. 4, all the tubes 7 are connected to the hollow body 6 by means of the tapered element 12. In addition, as illustrated in greater detail in FIG. 5, the pressure transducer 20 is equipped with a threaded element 35 and is positioned on a radial hole 36 of the hollow body 6. The threaded element 35 engages a threaded sleeve 37, fixed on the hollow body 6, and acts on another tapered seal element 38. Consequently, the transducer 20 is located in a centroidal position of the hollow body 6. Instead, as illustrated in greater detail in FIG. 6, the terminal portion 18 of the hollow body 6 is closed by a plug 39, which effectively seals said terminal portion 18 of the hollow body 6.

From the foregoing description, the advantages of the invention as compared to connections of the known art are evident. In particular, provision of the millings 31, 32 on the hollow body 6 enables secure and effective gripping thereof, whilst positioning of the millings 31, 32 themselves in the way indicated renders unnecessary any oversizing the diameter D of the hollow body 6 itself to guarantee the necessary structural strength.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications and improvements may be made to the connection system described above, without departing from the spirit and scope of the invention. Accordingly, the invention is not limited except as by the appended claims. For example, the union 19 can be made of a single piece with the delivery pipe of the high-pressure pump. In addition, the pressure transducer 20 can be located in a centroidal position of the hollow body 6, and hence set in a radial position, rather than an axial position, for example for reasons of engine arrangement.

The invention claimed is:

1. A system for reducing the size of a tubular rail for high-pressure fluid for an internal-combustion engine, in which the rail is obtained from a hollow body with a pre-set external diameter and a pre-set internal diameter; said system being characterized in that said hollow body has two terminal portions, each provided with an external milling having a diameter smaller than said external diameter and such as to form a corresponding shoulder to permit gripping thereof during assembly and/or maintenance.

2. The system according to claim 1, characterized in that at least one terminal portion of said hollow body has a pre-set internal diameter greater than the internal diameter of said hollow body and is connected at the front to a corresponding coaxial element.

3. The system according to claim 2, characterized in that said coaxial element has an internal diameter smaller than the internal diameter of said hollow body and a pre-set thickness, said milling being such as to guarantee, together with the thickness of said coaxial element, a radial strength not lower than that of said hollow body comprised between said terminal portions.

4. The system according to claim 2, characterized in that said terminal portion moreover has an internal milling designed to define a corresponding internal shoulder, said coaxial element engaging at the front said internal shoulder.

5. The system according to claim 4, characterized in that set between said internal shoulder and said coaxial element is a washer made of softer material, which has a sealing function.

6. The system according to claim 4, characterized in that the length of said external milling is smaller than that of said internal milling.

7. The system according to claim 6, characterized in that said terminal portion is connected to said coaxial element in a removable way, by means of a thread or by interference fit.

8. The system according to claim 1, characterized in that said external milling has a circular or polygonal cross section.

9. A system for front connection between a tubular rail and at least one coaxial element in a system for supplying fuel for an internal-combustion engine, in which said rail comprises a hollow body with a pre-set internal diameter and a pre-set external diameter, said coaxial element having a cylindrical portion with an external diameter smaller than the external diameter of said hollow body, said cylindrical portion having a plane front surface; said system being characterized in that said hollow body has a terminal portion with an oversized internal diameter so as to house said cylindrical portion and so as to form an annular shoulder.

10. The connection system according to claim 9, characterized in that, set between said annular shoulder and said front surface is a washer made of a relatively soft material.

11. The connection system according to claim 10, in which said hollow body and the cylindrical portion of said coaxial element are made of steel, said system being characterized in that the material of said washer is soft iron.

12. The connection system according to claim 10, characterized in that the external diameter of said cylindrical portion is slightly greater than the internal diameter of said terminal portion, said coaxial element being fixed on said rail forcing it axially or by means of pre-heating of said terminal portion.

13. The connection system according to claim 10, characterized in that said cylindrical portion is threaded on the outside and is screwed to an internal thread of said terminal portion.

14. The connection system according to claim 8, characterized in that said terminal portion has an external milling having a reduced external diameter in such a way as to enable mechanical gripping thereof, said reduced external diameter being such as to ensure, together with said cylindrical portion, a radial strength at least equal to that of said hollow body.

15. The connection system according to claim 14, characterized in that said terminal portion has an internal milling having a length not smaller than that of said external milling.

16. The connection system according to claim 15, characterized in that the external milling of said terminal portion has a length not greater than that of said cylindrical portion.

17. The connection system according to claim 15, characterized in that said coaxial element is made of a single piece with a pressure transducer.

18. The connection system according to claim 15, characterized in that said coaxial element is formed by a diameter adapter for a connection to a delivery pipe of a high-pressure fuel pump.

19. The connection system according to claim 15, characterized in that said rail has two opposite terminal portions, one of said terminal portions being connected to said adapter, the other of said terminal portions being designed to be connected to said pressure transducer.

* * * * *